US005709424A

United States Patent [19]

Schuler

[11] Patent Number: 5,709,424

[45] Date of Patent: Jan. 20, 1998

[54] APPARATUS FOR ELASTICALLY GRIPPING AND HOLDING AN ARTICLE

[76] Inventor: John Schuler, 126 Old Connecticut Path, Wayland, Mass. 01778

[21] Appl. No.: 748,060

[22] Filed: Nov. 13, 1996

[51] Int. Cl.[6] ..... B65D 63/18

[52] U.S. Cl. ..... 294/148; 294/142; 294/156; 294/165

[58] Field of Search ..... 294/31.2, 137, 294/138, 142, 148–150, 153, 156, 165, 166; 248/76–78

[56] References Cited

U.S. PATENT DOCUMENTS

| | | | |
|---|---|---|---|
| 3,098,315 | 7/1963 | Bono | 294/165 |
| 3,400,870 | 9/1968 | Vietri | 294/150 |
| 4,402,542 | 9/1983 | Kreutzer | 294/156 |
| 4,696,505 | 9/1987 | Shadoan | 294/153 |
| 4,796,936 | 1/1989 | Sherin | 294/148 |
| 5,096,248 | 3/1992 | Ryan | 294/150 |
| 5,238,162 | 8/1993 | LaCivita | 294/148 |
| 5,348,362 | 9/1994 | Rolls | 294/165 |

*Primary Examiner*—Dean Kramer
*Attorney, Agent, or Firm*—Brian M. Dingman

[57] ABSTRACT

An apparatus for elastically gripping and holding an article, comprising: a flexible elongated handle member lying generally along a longitudinal handle axis, the handle defining an interior carrying opening proximate one end, and including a strap coupling area spaced from the carrying opening; a flexible, elastic strap coupled to the handle member at the strap-coupling area and extending therefrom to a distal end; and a cooperating releasable coupling structure, partially proximate the distal end of the strap and also partially coupled to the handle member, to allow the strap to be releasably fastened to the handle member; whereby the strap can be stretched tightly around an article, and then coupled to the handle member, to grip and hold the article. The apparatus allows the article to be carried or hung by the carrying opening in the handle member.

7 Claims, 2 Drawing Sheets

APPARATUS FOR ELASTICALLY GRIPPING AND HOLDING AN ARTICLE

FIELD OF INVENTION

This invention relates to a flexible fastening member with an elastic strap extending therefrom that tightly grips and holds an article, particularly a coiled cord, rope or the like.

BACKGROUND OF INVENTION

There are many situations in which it is desirable to hold together a coiled cord, rope, wire, hose, or similar elongated, thin, flexible article. If such articles are not coiled, and the coil held together in some manner, they become tangled and difficult to work with. Most times the coils are held together using an end portion of the article that is wrapped around the coil and tied off. This coiling and tying procedure is cumbersome, and sometimes difficult. Also, there is no simple means of storing such a coiled article by hanging from a nail or the like protruding from a wall. Hanging the coiled article by the coil itself can damage the article, as the weight of the article rests entirely on the small top surface of the nail.

SUMMARY OF INVENTION

It is therefore an object of this invention to provide an apparatus for tightly gripping and holding an article.

It is a further object of this invention to provide such an apparatus which is flexible so that it wraps around the article.

It is a further object of this invention to provide such an apparatus which allows an article to be hung from a wall or such.

It is a further object of this invention to provide such an apparatus which greatly simplifies the storage of a coiled, elongated flexible member such as a wire, hose or rope.

It is a further object of this invention to provide such an apparatus which allows such a coiled member to be stored without damage.

This invention results from the realization that coiled wires, ropes, hoses and the like, as well as other articles which need to be held together in storage, such as sails, can be tightly held together for storage with an apparatus which includes a flexible, elongated handle member that bends partially around the article, with a protruding, elongated, flexible elastic strap that is stretched around the remainder of the article and releasably coupled to the handle member.

This invention features an apparatus for elastically gripping and holding an article, comprising: a flexible elongated handle member lying generally along a longitudinal handle axis, the handle defining an interior carrying opening proximate one end, and including a strap coupling area spaced from the carrying opening; a flexible, elastic strap coupled to the handle member at the strap-coupling area and extending therefrom to a distal end; and cooperating releasable coupling means partially proximate the distal end of the strap and also partially coupled to the handle member, to allow the strap to be releasably fastened to the handle member; whereby the strap can be stretched tightly around an article, and coupled to the handle member, to grip and hold the article, to allow the article to be carried or hung by the carrying opening in the handle member.

The handle member may also include a gripping portion extending from the strap-coupling area generally along the longitudinal handle axis, the gripping portion being adapted to bend partially around the article being held, and the gripping portion lying under the strap when the strap is stretched around the article and fastened to the handle. The gripping portion may carry, on the portion under the strap, the coupling means portion that is coupled to the handle member, to allow the strap to be fastened to the gripping portion. The strap-coupling area may include two parallel, elongated strap openings lying essentially perpendicular to the longitudinal handle axis, which together define an intermediate bar, whereby the strap runs through both strap openings and around the bar, to couple the strap to the handle member. The cooperating releasable coupling means may include a hook and loop, two-part contact fastener.

Also featured is an apparatus for elastically gripping and holding an article, comprising: a flexible handle member including a strap coupling area, and a gripping portion adapted to bend partially around the article being held; a flexible, elastic strap coupled to the handle member at the strap-coupling area and extending therefrom to a distal end; and releasable, two-part, contact fastener means, one part along at least a portion of the strap, and the second part on the handle member gripping portion; whereby the strap can be stretched tightly around an article, and releasably fastened to the handle member gripping portion, to grip and hold the article. The contact fastener means may include a hook and loop-type fastener. The portion on the strap can be placed along the entire length of the strap, so that articles of any size can be held.

Also featured is a method of bundling together a coiled, thin, elongated article such as a wire, rope or hose, using an apparatus comprising: a flexible handle member including a strap coupling area, and a gripping portion adapted to bend partially around the article being held; a flexible, elastic strap coupled to the handle member at the strap-coupling area and extending therefrom to a distal end; and releasable, two-part, contact fastener means, one part along a portion of the strap, and the second part on the handle member gripping portion; whereby the strap can be stretched tightly around an article, and releasably fastened to the handle member gripping portion, to grip and hold the article. The method includes the steps of: holding the coiled article in a first hand, and the handle member in the other hand; while holding the handle member, contacting it against the coiled article and bending the gripping portion partially around the coiled article with the other hand; gripping the strap with the first hand, and stretching it around the coiled article; and contacting the part of the fastener means on the stretched strap with the part of the fastener means on the handle member gripping portion to hold the strap in the stretched state around the coiled article, to bundle together the coiled article.

BRIEF DESCRIPTION OF THE DRAWINGS

Other objects, features and advantages will occur to those skilled in the art from the following description of the preferred embodiments, and the accompanying drawings, in which.

DESCRIPTION OF THE PREFERRED EMBODIMENTS

This invention may be accomplished in an apparatus for elastically gripping and holding an article. The apparatus is particularly adapted for use with coiled wires, ropes, hoses and the like which need to be held together as a coil, and stored by hanging on a nail or the like. The apparatus can also be used for holding together other loose, flexible items, for example furled sails, vacuum cleaner hoses, a pair of skis, a bundle of envelopes, or to hold a life preserver and hang it from a lifeline on a boat.

This invention also features a method of bundling together a coiled, thin, elongated article such as a wire, rope or hose, using an apparatus such as that disclosed in this application.

Figure 1:
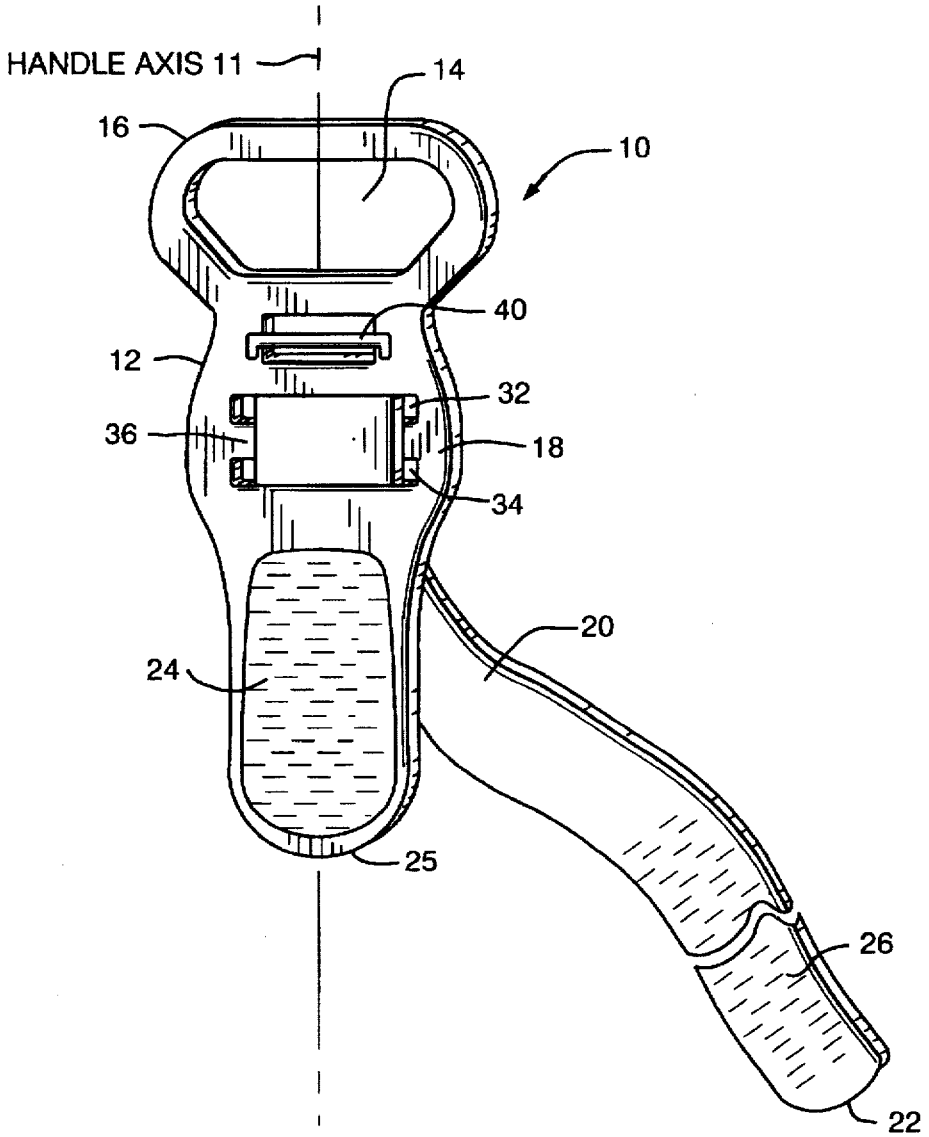
FIG. 1 is a top plan view of a preferred embodiment of the apparatus of this invention, and a preferred apparatus for the method of this invention.

There is shown in FIG. 1 apparatus 10 according to this invention. Apparatus 10 includes a flexible elongated handle member 12 lying generally along longitudinal handle axis 11. Handle 12 defines an interior handle carrying opening 14 proximate end 16. Opening 14 is large enough for two or three fingers, so that the article gripped and held by apparatus 10 can be carried by one hand. Handle member 12 is sufficiently flexible so that it can be at least partially wrapped around an article having a generally circular cross-section, for example a coiled hose or wire, or a furled sail. The flexibility may be accomplished by molding handle member 12 of a plastic material such as polypropylene.

Apparatus 10 also includes flexible, elongated, elastic strap 20 coupled to handle member 12 at strap-coupling area 18, and extending therefrom. Strap 20 can alternatively be coupled at end 16. Strap 20 can be coupled to handle member 12 in any convenient fashion. One manner is depicted in the drawings, in which there is a bar 36 defined by parallel, elongated strap openings 32 and 34. Strap 20 is looped around bar 36, and end 52 (FIG. 2) is sewn (or fixed in another fashion, such as with a two-part VELCRO fastener) to strap 20 to couple strap 20 to handle member 12.

Apparatus 10 further includes cooperating releasable coupling means comprised of one portion of a hook and loop-type fastener on handle member 12, and the other portion of the hook and loop-type fastener along a surface of, and at least proximate distal end 22 of strap 20. An example of such hook and loop type, two-part fastener is VELCRO®. The cooperating releasable coupling means of apparatus 10 includes hook fastener portion patch 24 fixed to handle member 12 proximate end 25, and loop fastener portion 26 fixed to strap 20 proximate end 22. Portion 26 may extend along the entire length of strap 20 to provide effective strap length adjustability, so that smaller articles can be tightly gripped. The hook and loop fastener comprised of patch 24 and portion 26 allows strap 20 to be releasably fastened to handle member 12. Other releasable coupling means are contemplated, for example a strap and buckle or snap arrangement, or equivalent means for holding the stretched strap on the handle member.

Figure 2:
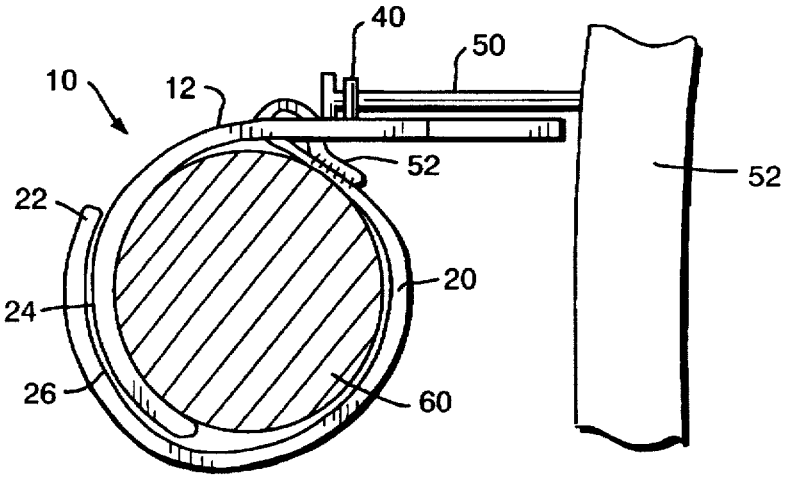
FIG. 2 is a side, partially cross-sectional, view of the apparatus of FIG. 1 holding a coiled member, and hung from a nail protruding from a wall.
Figure 3:
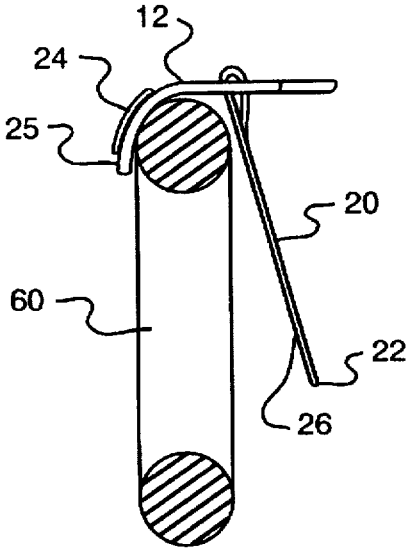
FIGS. 3 and 4 are similar views showing the manner in which the apparatus of FIG. 1 is coupled to the coiled member.
Figure 4:
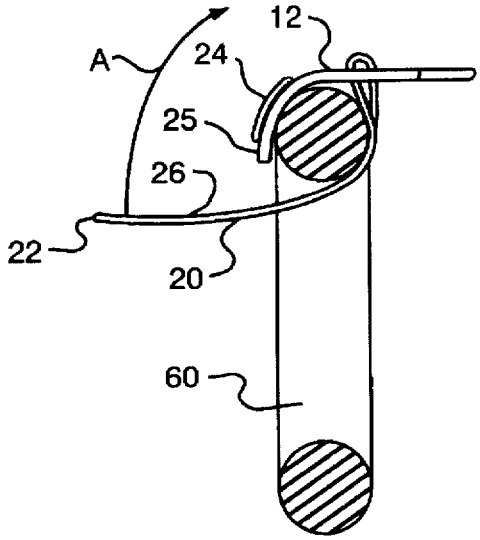

As shown in FIGS. 2 through 4, strap 20 can be stretched tightly around an article such as coiled article 60, and coupled to handle member 12 by contacting loop fastener portion 26 to hook fastener portion 24. Such is accomplished by holding the article 60 in a first hand, and apparatus 10 in the other hand. While apparatus 10 is held, it is contacted against coiled article 60, and gripping portion 25 is bent partially around article 60 (by the thumb of the first hand), as shown in FIG. 3. Strap 20 is then gripped with the other hand that was initially holding article 60, and stretched around article 60. Coupling or fastening portion 26 carried along strap 20 is then pressed against coupling or fastening portion 24 on handle member 12, to releasably hold strap 20 in the stretched state around coiled article 60, to bundle together coiled article 60.

FIG. 2 is an example of the manner in which apparatus 10 can be used to store a held article. Handle member 12 includes protruding "U" shaped portion 40 which defines an opening which can be slipped over hook or nail 50 protruding from wall 52. Since the weight of coiled member 60 is carried by relatively wide strap 20, the weight is distributed over a relatively large area. Accordingly, there is less likely to be damage caused to article 60 from its been hung from a wall, as opposed to article 60 being hung directly on nail 50. Alternatively, handle member 12 can be hung by opening 14.

Figure 5:
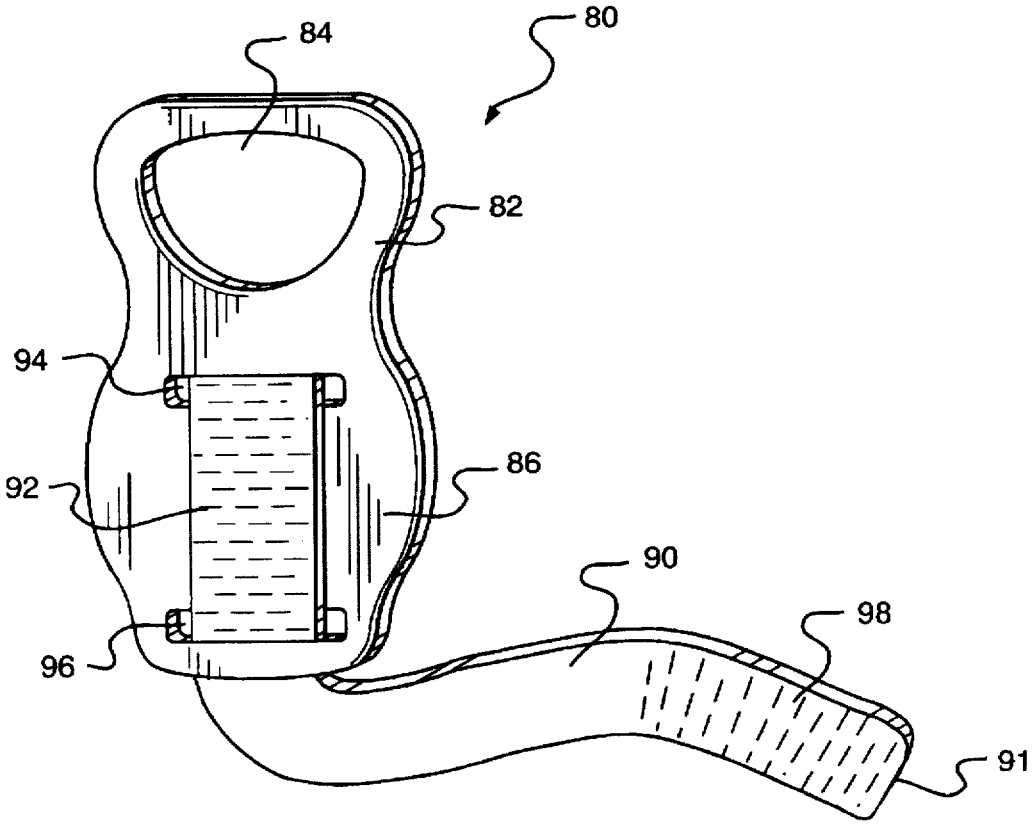
FIG. 5 is a top plan view of an alternative embodiment of the apparatus of this invention.

The apparatus of this invention can take other forms as well. For example, apparatus 80, FIG. 5, includes flexible handle member 82 defining interior carrying opening 84. Strap 90 has one portion 98 of hook and loop fastener proximate distal end 91, and the other portion 92 on strap 90 and arranged such that portion 92 is along a gripping portion 86 of handle member 82. Such is accomplished by spacing elongated strap openings 94 and 96 so that a sufficient length of strap 90 lies along the upper surface of handle member 82 to present enough area of fastener portion 92 to tightly hold the fastener portion 98.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An apparatus for elastically gripping and holding an article, comprising:

a flexible elongated handle member lying generally along a longitudinal handle axis having an anterior and a posterior end, the handle defining an interior carrying opening proximate the anterior end, and including a strap coupling area spaced from the carrying opening;

a flexible, elastic strap coupled to the handle member at the strap-coupling area and extending therefrom to a distal end;

cooperating releasable coupling means partially proximate the distal end of the strap and also partially coupled to the handle member proximate said posterior end, to allow the strap to be releasably fastened to the handle member;

wherein said strap-coupling area is provided between said interior carrying opening and said releasable coupling means coupled to the handle member;

whereby the strap can be stretched tightly around an article, and coupled to the handle member, to grip and hold the article, to allow the article to be carried or hung by the carrying opening in the handle member;

wherein the handle member further includes a gripping portion extending from the strap-coupling area generally along the longitudinal handle axis proxmiate the posterior end, the gripping portion being adapted to bend partially around the article being held, and the gripping portion lying under the strap when the strap is stretched around the article and fastened to the handle; and wherein the gripping portion carries, on the portion under the strap when the strap is stretched around the article and fastened to the handle, the releasable coupling means portion that is coupled to the hand member, to allow the strap to be fastened to the gripping portion.

2. The apparatus of claim 1 in which the strap-coupling area includes two parallel, elongated, strap openings, lying perpendicular to the longitudinal handle axis, which together define an intermediate bar, whereby the strap runs through both strap openings and around the bar, to couple the strap to the handle member.

3. The apparatus of claim 1 in which the cooperating releasable coupling means includes a hook and loop two part contact fastener.

4. The apparatus of claim 1 further including a generally "u" shaped member defining a handle-hanging opening, the "u" shaped member extending from the handle member transverse to the handle member handle axis.

5. An apparatus for elastically gripping and holding an article, comprising:

a flexible handle member including a carrying portion, a strap coupling area, and a gripping portion adapted to bend partially around the article being held, wherein said strap coupling area is provided between said carrying portion and said gripping portion;

a flexible, elastic strap coupled to the handle member at the strap-coupling area and extending there from to a distal end; and releasable, two-part, contact fastener means, one part along a portion of the strap, and the second part on the handle member gripping portion;

whereby the strap can be stretched tightly around an article, and releasably fastened to the handle member gripping portion, to grip and hold the article.

6. The apparatus of claim 5 in which the contact fastener means includes a two-part, hook and loop-type fastener.

7. A method of bundling together disarticulated articles, using an apparatus comprising; a flexible handle member including a carrying portion, a strap coupling area, and a gripping portion adapted to bend partially around the article being held, wherein said strap-coupling area is provided between said carrying portion and said gripping portion; a flexible, elastic strap coupled to the handle member at the strap-coupling area and extending therefrom to a distal end; and releasable, two-part, contact fastener means, one part along a portion of the strap, and the second part on the handle member gripping portion; whereby the strap can be stretched tightly around an article, and releasably fastened to the handle member gripping portion, to grip and hold the article; the method including the steps of;

holding the disarticulated articles in a first hand, and the handle member in the other hand;

while holding the handle member, contacting it against the disarticulated articles, and bending the gripping portion partially around the disarticulated articles with the other hand;

gripping the strap with the first hand, and stretching it around the disarticulated articles; and contacting the part of the fastener means on the stretched strap with the part of the fastener means on the handle member gripping portion, to hold the strap in the stretched state around the disarticulated articles, to bundle together the disarticulated articles.

* * * * *